United States Patent [19]

Rundell

[11] Patent Number: 4,716,962

[45] Date of Patent: Jan. 5, 1988

[54] STRIPPING GLAND

[75] Inventor: Herbert A. Rundell, Houston, Tex.

[73] Assignee: Texaco Inc., White Plains, N.Y.

[21] Appl. No.: 803,263

[22] Filed: Nov. 29, 1985

[51] Int. Cl.[4] ..... E21B 33/08

[52] U.S. Cl. ..... 166/84; 285/110; 285/351; 174/65 SS; 166/82

[58] Field of Search ..... 166/82, 83, 84, 75.1, 166/97.5, 88, 89; 285/110, 351, 356, 387, 388; 277/DIG. 8; 174/151, 65 SS

[56] References Cited

U.S. PATENT DOCUMENTS

| | | | |
|---|---|---|---|
| 2,255,829 | 9/1941 | Spang et al. | 166/82 |
| 3,741,568 | 6/1973 | Rhoades | 166/82 |
| 4,060,249 | 11/1977 | Stowe et al. | 166/82 |
| 4,154,302 | 5/1979 | Cugini | 166/97.5 |
| 4,379,556 | 4/1983 | Rundell et al. | 166/84 |

FOREIGN PATENT DOCUMENTS

| | | | |
|---|---|---|---|
| 0974459 | 12/1960 | Fed. Rep. of Germany | 174/65 SS |

*Primary Examiner*—James A. Leppink
*Assistant Examiner*—Terry Lee Melius
*Attorney, Agent, or Firm*—Robert A. Kulason; James J. O'Loughlin; Ronald G. Gillespie

[57] ABSTRACT

A stripping gland is specially designed to act on uneven surfaced leads or the like making up a bundle that extends down into a well. It includes plural interior annular grooves which accommodate flexible seals. It also has an upper cylindrical chamber that has a highly elastic stationary seal which may be compressed tightly around the bundle.

5 Claims, 4 Drawing Figures

STRIPPING GLAND

BACKGROUND OF THE INVENTION

Field of the Invention

This invention concerns stripping glands in general and more specifically realtes to a stripping gland for an irregular surfaced bundle of leads or the like that extend into a well.

Description of the Related Art

A preferred application of this invention relates to a type of petroleum product recovery from oil shale. In such type recovery, wells are drilled into the shale and an application of heat is made down in one or more of the wells in order to liquify the petroleum products and thereby to obtain the extraction thereof, in situ. In the course of such operations, use is made of radio frequency energy absorption. Radio frequency energy is applied to the shale to thus heat and extract the products as they are released into a well or surrounding wells. During the procedure it is necessary to obtain a temperature profile of the formation within the heated area, and various wells are often drilled within a pattern to serve as production wells and temperature monitoring wells. The temperature monitoring may be accomplished by lowering temperature sensing devices into the well, but that may only be done while the radio frequency power that is used in heating the shale has been shut off. The reason for that is that the sensing devices, such as thermocouples, will short out the radio frequency field. Consequently, the technique involves the lowering of thermocouples (which are usually combined in a bundle of several shielded-type thermocouples), down into the well to a desired depth. Then they are held in position until equilibrium is reached, and thereafter they are retrieved so that the power may be turned on once more for the heating procedure. During such a procedure, the lowering and removal of a bundle of thermocouple leads into the well requires a sealing gland which is in the nature of a stripping gland, in order to prevent well products from escaping into the atmosphere.

Consequently, it is an object of this invention to provide a stripping gland that is for use with irregular surfaced bundle of thermocouples or the like. It acts to provide a seal for the petroleum products during running of the leads into and out of a well.

Another object of the invention is to provide a stripping gland for an irregular surfaced bundle of leads or the like which includes a cylindrical chamber that holds a highly elastic stationary seal.

SUMMARY OF THE INVENTION

Briefly, the invention concerns a stripping gland for an irregular surfaced bundle of thermocouples or the like having long leads for running down a well. It comprises a cylindrical body member having an axial passage therethrough for accommodating said bundle and leads for free relative movement therein, and a plurality of annular interior grooves in said body member spaced apart longitudinally from one another for accommodating flexible seals therein. It also comprises an upper cylindrical chamber in said body member for holding a highly elastic stationary seal.

Again briefly, the invention concerns a stripping gland for an irregular surfaced bundle of thermocouples or the like having long leads for running down a well. It comprises in combination a cylindrical body member having an axial passage therethrough for accommodating said bundle and leads for free relative movement therein. The said body member is split longitudinally into two halves for installing between the ends of said bundle. It also comprises three annular interior grooves in said body member spaced apart longitudinally from one another and located in the lower portion thereof for holding flexible seals therein, and an upper cylindrical chamber in said body member having an inside diameter greater than said axial passage for holding a foam rubber stationary seal. The said chamber is open at the top and is threaded to receive a packing nut for compressing said foam rubber seal. The said body member has pipe threads at the lower end thereof for attaching said stripping gland to a well head. It also comprises a shallow exterior groove adjacent to said upper cylindrical chamber for accommodating a hose clamp to hold said two halves together, and plural pairs of pins chordally located in said body member for holding said two halves in alignment. It also comprises chordal flat surfaces on the exterior of said body member for applying a wrench to tighten said pipe threads.

BRIEF DESCRIPTION OF THE DRAWINGS

The foregoing and other objects and benefits of the invention will be more fully set forth below in connection with the best mode contemplated by the inventor of carrying out the invention, and in connection with which there are illustrations provided in the drawings, wherein.

DESCRIPTION OF THE PREFERRED EMBODIMENT

Figure 1:
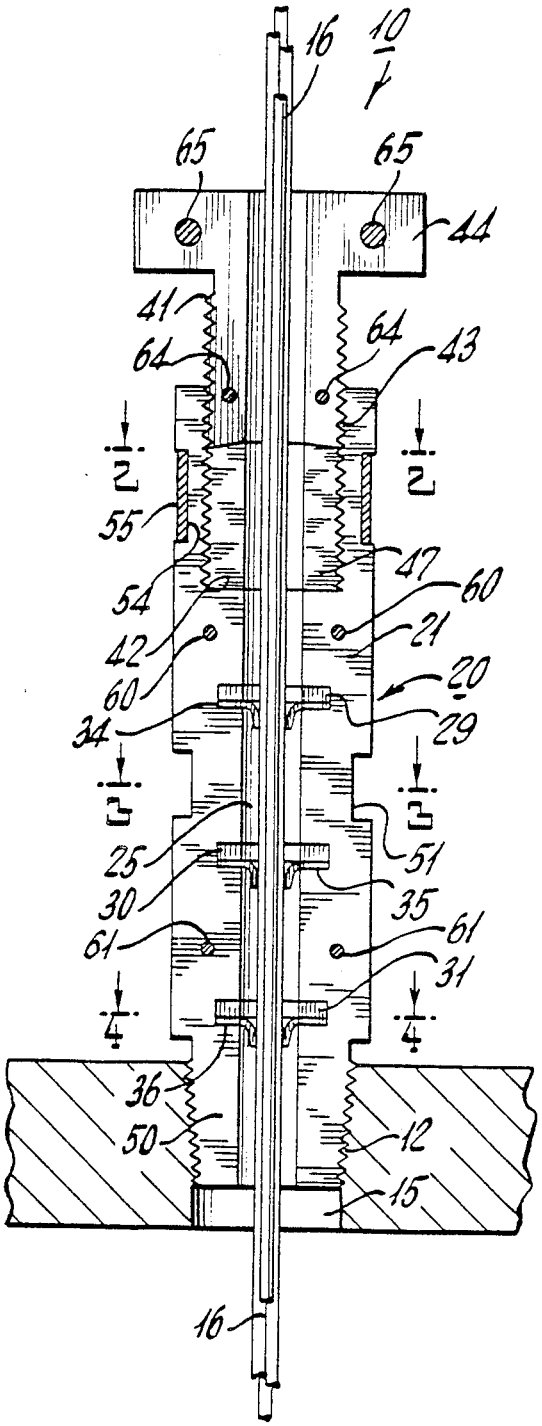
FIG. 1 is longitudinal elevation, partly in cross section, showing one-half of the stripping gland in place in a well head.
Figure 2:
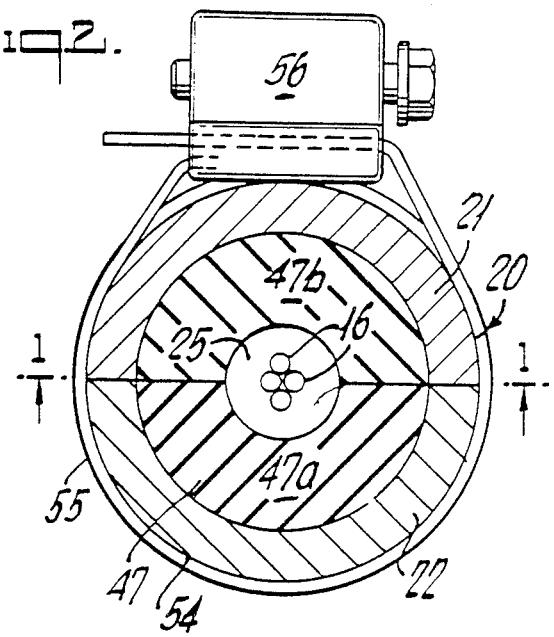
FIG. 2 is an enlarged transverse cross section taken along the lines 2—2 of FIG. 1, and looking in the direction of the arrows.
Figure 3:
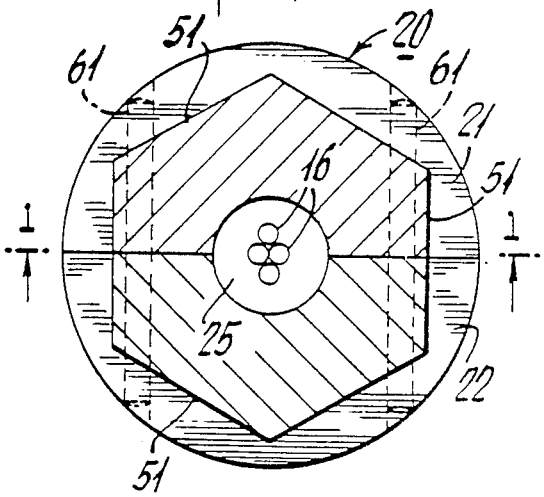
FIG. 3 is another enlarged transverse cross section, taken along the lines 3—3 of FIG. 1 and looking in the direction of the arrows.
Figure 4:
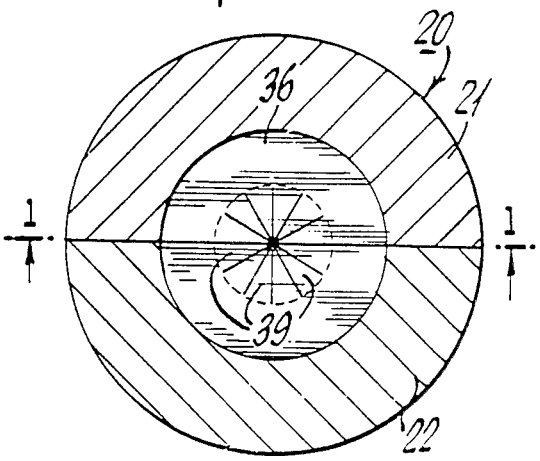
FIG. 4 is yet another enlarged transverse cross section view taken along the lines 4—4, and looking in the direction of the arrows.

The drawings illustrate a preferred modification of a stripping gland according to the invention. It will be noted that the FIG. 1 showing illustrates one half of a complete stripping gland which has a structure that is split longitudinally in order to accommodate mounting the gland onto a bundle of long leads between the ends thereof. Such long leads will be run into and out of a well while the well products are prevented from escaping, as indicated above. The enlarged cross sectional views of FIGS. 2, 3 and 4 show both halves of the stripping gland as they are mounted together when the gland is in place at a well head.

FIG. 1 shows a cross sectional fragment of a well head 11 into which a stripping gland 10, according to the invention, is fastened. Such fastening is preferably done by means of pipe threads 12 cut into the top portion of an opening 15 in the well head 11. A bundle 16 of long leads for thermocouples extend down through the opening 15 in well head 11. These are for raising and lowering the thermocouples (not shown) into a well.

The stripping gland 10 is made with two halves by splitting it longitudinally so that it may be mounted onto the bundle of leads 16 between the ends thereof. Thus, FIG. 1 shows an assembly of the stripping gland 10 with the view taken at the parting line, i.e., along the lines 1—1 on FIGS. 2,3 and 4. It will be understood that the two halves are held together as the stripping gland is mounted in place at the well head 11.

The whole stripping gland 10 is made up of a cylindrical body member 20 which has two halves 21 and 22 that fit together at the flat parting line surfaces. When fitted together these halves 21 and 22 form an axial passage 25 that runs longitudinally the length of the gland 10. This passage 25 has a diameter large enough to freely accommodate the bundle 16 of leads in order to permit their movement through the gland 10 as the thermocouples (not shown) are raised and lowered in the well.

There are three annular interior grooves 29, 30 and 31 which accommodate three thin flexible seals 34, 35 and 36, respectively for sealing and stripping the bundle 16 during movements thereof. It may be noted that these three seals are made of flat discs with the central portion of each split into pie shaped sections having radial separation. This is done in order to accommodate the uneven surfaces of the bundle 16. Thus, the seal 36 which is shown in FIG. 4 omits the bundle of leads 16 and shows plural pie shaped segments 39 which are separated radially from one another while being part of the disc structure of the seal 36.

It will be understood that the seals 34, 35 and 36 are substantially identical, and in each case they will be manufactured as circular discs and then cut diagonally to match the two halves 21 and 22 of the body member 20. Also the radial segment separations are cut so that the two halves of the seals are compatible for installation within the split halves 21 and 22 of the body member 20 of the gland 10 as it is assembled.

There is an upper cylindrical chamber 42 in the body member 20. It has a female threaded inside diameter which is greater than the diameter of the axial passage 25. The female threaded walls 43 are cut to accomodate male threads 41 on a packing nut 44. There is a foam or sponge rubber stationary seal 47 which is a relatively short hollow cylinder in shape. This cylinder 47 may be compressed by the packing nut 44 when the bundle 16 is held stationary, in order to make a tight seal at the upper end of the body member 20 of the gland 10. It will be understood that the seal 47 similarly as is the case with the thin seal discs 34, 35 and 36, is split longitudinally into two halves 47*a* and 47*b* in order to accommodate the split structure of the body member 20 and packing nut 44.

Body member 20 has a pipe threaded lower end 50 that screws into the pipe threads 12 of the well head opening 15. Also, the body member 20 has hexagonal flat surfaces 51 located above the pipe threaded end 50 in order to provide for the use of a wrench in tightening the body member 20 in place in the well head 11.

Near the upper end of the body member 20 there is a shallow peripheral groove 54 which accommodates a band 55 of a hose clamp 56. It will be understood that the hose clamp 56 will be applied to the body member 20 after the two halves thereof have been mounted together while surrounding the bundle 16.

There are two pairs of pins 60 and 61 which are located in cordal holes drilled through the body member 20. These pins 60 and 61 act to hold the two halves of the body member in alignment after they have been mounted around the bundle 16. Similarly, there are two pairs of pins 64 and 65 located in the packing nut 44 to hold its two halves in alignment after mounting around the bundle 16.

It will be appreciated that the seals 34, 35 and 36 might be constructed with small sized central holes (not shown) if the flexibility is sufficient to accommodate the bundle, instead of using the split finger type structure illustrated. Also, it may be noted that the purpose for constructing the entire stripping gland in two halves is in order to accommodate the mounting thereof on a bundle 16 between the ends thereof. This is especially necessary where the bundle includes a sinker bar or the like at its lower end for applying the downward force in lowering the bundle into the well.

While a particular embodiment of the invention has been described in considerable detail in accordance with the applciable statutes, this is not to be taken as in any way limiting the invention but merely as being descriptive thereof.

I claim:

1. A stripping gland comprising:

housing means having an axial passage therethrough for accommodating an object having an irregular surface, and a plurality of means located in said housing means for forming seals within said passage beteen the housing means and the irregular surface of the object, wherein the housing means and seal means are separable into the two sections to facilitate utilization with the object, and said stripping gland further comprises means for clamping the two sections of housing and seal means together, means located within the housing for providing sealing between the housing and the object when compressed, the compressible sealing means being separated in two sections, a section of compressible sealing means is located in each section of the housing, and means for compressing the compressible sealing means after the two sections of the housing are clamped together.

2. A stripping gland as described in claim 1 in which the two sections of each sealing means in the plurality of sealing means when united form a disk with radial separations which start from substantially the center of the disk and radiate from the center a predetermined distance substantially less than the radius of the disk.

3. A stripping gland according to claim 2, also comprising:

pin means for holding said two sections in alignment, and chordal flat surfaces on the exterior of said housing for applying a wrench to tighten said pipe thread means.

4. A stripping gland according to claim 3, also comprising:

pipe thread means at the lower end of said housing member for attaching said stripping gland to a well head.

5. Stripping gland according to claim 4 wherein said body member is split longitudinally into two halves, and said stripping gland also comprises exterior groove means adjacent to said upper cylindrical chamber for accommodating a clamp to hold said two halves together.

* * * * *